United States Patent [19]

Allais et al.

[11] Patent Number: 5,056,409

[45] Date of Patent: Oct. 15, 1991

[54] LIGHTWEIGHT DEPLOYABLE TURRET

[75] Inventors: Jean-Philippe P. B. Allais, Montivilliers; Alain R. Guillermond, Epouville; Pascal G. Rouyer, Le Havre, all of France

[73] Assignee: Societe Anonyme Dite Hispano Suiza, Saint Cloud Cedex, France

[21] Appl. No.: 560,729

[22] Filed: Jul. 31, 1990

[30] Foreign Application Priority Data

Jul. 31, 1989 [FR] France ..... 89 10289

[51] Int. Cl.[5] ..... F41A 23/34; F41A 23/50

[52] U.S. Cl. ..... 89/37.01; 89/37.02; 89/40.03

[58] Field of Search ..... 89/37.01, 37.02, 37.03, 89/37.04, 37.08, 38, 39, 40.01, 40.03, 41.01, 41.02

[56] References Cited

U.S. PATENT DOCUMENTS

| | | | |
|---|---|---|---|
| 641,872 | 1/1900 | Krone | 89/39 |
| 769,636 | 9/1904 | Rausenberger | 89/39 |
| 1,334,800 | 3/1920 | Schneider | 89/38 |
| 2,228,179 | 1/1941 | Motley | 89/37.03 |
| 2,336,557 | 12/1943 | McCallister | 89/37.01 |
| 4,141,277 | 2/1979 | Bouillon | 89/38 |
| 4,336,743 | 6/1982 | Horn et al. | 89/37.03 |
| 4,667,565 | 5/1987 | Anderson | 89/36.08 |

FOREIGN PATENT DOCUMENTS

| | | |
|---|---|---|
| 2043852 | 3/1971 | Fed. Rep. of Germany . |
| 2506002 | 11/1982 | France . |
| 556002 | 2/1946 | United Kingdom . |
| 1294006 | 10/1972 | United Kingdom . |

*Primary Examiner*—David H. Brown

*Attorney, Agent, or Firm*—Bacon & Thomas

[57] ABSTRACT

The present invention relates to a light weight turret for use on an armored vehicle that is easily movable between stowed and deployed positions. In the stowed position, the turret is folded downwardly adjacent to the top of the armored vehicle. In the deployed position, the turret extends above the top of the vehicle to provide the necessary clearances for use of the weapon at elevational angles between −15° and +45°. The turret consists of a pair of mounting members, each having a generally "U" shape with their bases pivotally attached to a support plate which, in turn, is pivotally attached to the top of the vehicle. Cross members connect the mounting members and pivotally mount a weapon support. The pivot axis of the weapon support extends generally horizontally and, when the turret is deployed, is located in a plane with the generally vertical azimuth axis about which the turret rotates. Actuators may be provided to assist in the movement of the members from their stowed to their deployed positions.

14 Claims, 4 Drawing Sheets

LIGHTWEIGHT DEPLOYABLE TURRET

BACKGROUND OF THE INVENTION

This invention relates to a lightweight, deployable turret, such as those utilized for anti-aircraft weapons mounted on the roof of a lightweight, armored vehicle.

It is known in the art to mount various types of turrets or carriages for light weapons on the roof of an armored vehicle. Access to the turret is usually obtained from the interior of the vehicle via a hatch in the vehicle roof.

British Patent 1,294,006 describes a rocket launcher attached to the upper portion of a tracked vehicle. The rocket launcher includes a deformable parallelogram linkage structure and is located such that it completely overhangs from the front of the turret. This known structure does not make provisions for counter-balancing the weight of the weapons during deployment, nor does it provide for the adjustment of the elevational angle of the weapon between a negative angle and a large positive angle.

Most known turrets have the disadvantage of being cumbersome and difficult to operate. Such a cumbersome structure often prevents the use of the weapon at wide variations of elevational angles, which must typically range from −15° to +45°. Such elevational angles require the turret to be displaced from the upper portion of the vehicle in order to provide for the necessary clearances between the weapon and the vehicle.

Such bulkiness of the known turrets quite often constitutes a handicap for the vehicle mobility and, in most cases, prohibits the vehicle from being transported by air, a very serious handicap from an operational standpoint.

SUMMARY OF THE INVENTION

The present invention relates to a lightweight turret for use on an amored vehicle that is easily movable between stowed and deployed positions. In the stowed position, the turret is folded downwardly adjacent to the top of the armored vehicle. This minimizes the overall dimensions of the vehicle and greatly facilitates the transportation of the armored vehicle by air.

In the deployed position, the turret extends above the top of the vehicle to provide the necessary clearances for use of the weapon at elevational angles between −15° and +45°.

The turret consists of a pair of mounting members, each having a generally "U" shape with their bases pivotally attached to a support plate which, in turn, is pivotally attached to the top of the vehicle. Cross members connect the mounting members and pivotally mount a weapon support. The pivot axis of the weapon support extends generally horizontally and, when the turret is deployed, is located in a plane with the generally vertical azimuth axis about which the turret rotates. Actuators may be provided to assist in the movement of the mounting members from their stowed to their deployed positions. Additional actuators may be used to assist the operator in manually making the required elevational changes in the weapon support before firing the weapon.

The uncomplicated, lightweight structure of the turret accordingly to the present invention allows the operator to easily perform the target-finding and tracking maneuvers with short response times over an azimuth of 360°.

DETAILED DESCRIPTION OF THE PREFERRED EMBODIMENTS

A first embodiment of the turret according to the present invention is illustrated in FIGS. 1–4 in which the turret is shown attached to a roof 1 of an armored vehicle (not otherwise shown). The turret comprises a circular support plate 2 rotatably attached to a collar 3 so as to rotate about azimuth axis Z—Z over 360°.

Figure 2:
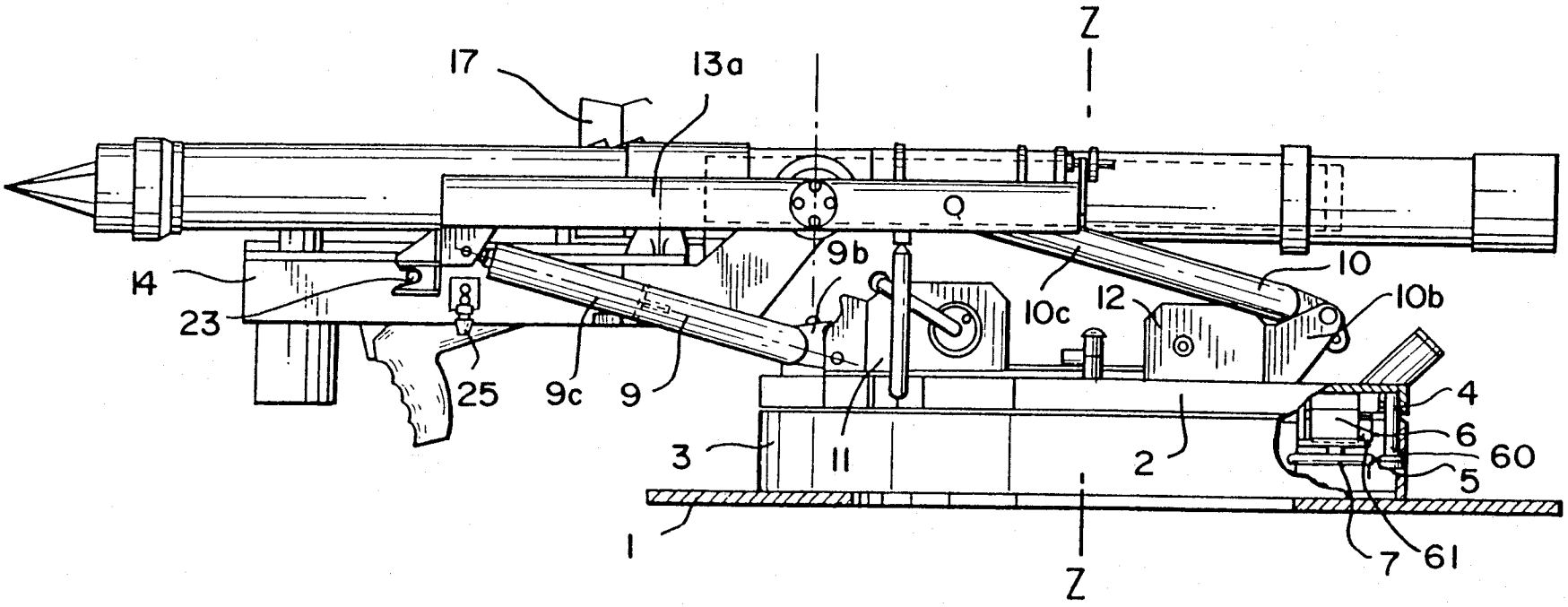
FIG. 2 is a side view similar to FIG. 1 illustrating the turret according to the present invention in its stowed position.

As best seen in FIG. 2, horizontal bearing structure 4 rotatably supports the support plate 2 on the collar 3. The collar also includes a ring gear 5 with which pinion gear 7 is engaged. In known fashion, pinion gear 7 forms a part of azimuth coder 6 to indicate the azimuth direction of the position of the support plate 2. Arm assembly 60 of the rotary joint and its tracks 61 are attached under the lower portion of the bearing 4.

Support plate 2 defines a generally centrally located opening which may be covered by a rectangular armored hatch 8. Hatch 8 may be pivotally attached to the support plate so as to be movable between a closed position illustrated in FIGS. 2–4, and an open position, illustrated in FIG. 1. When the hatch is open, the operator may gain access to the turret through the opening defined by the support plate 2.

Figure 1:
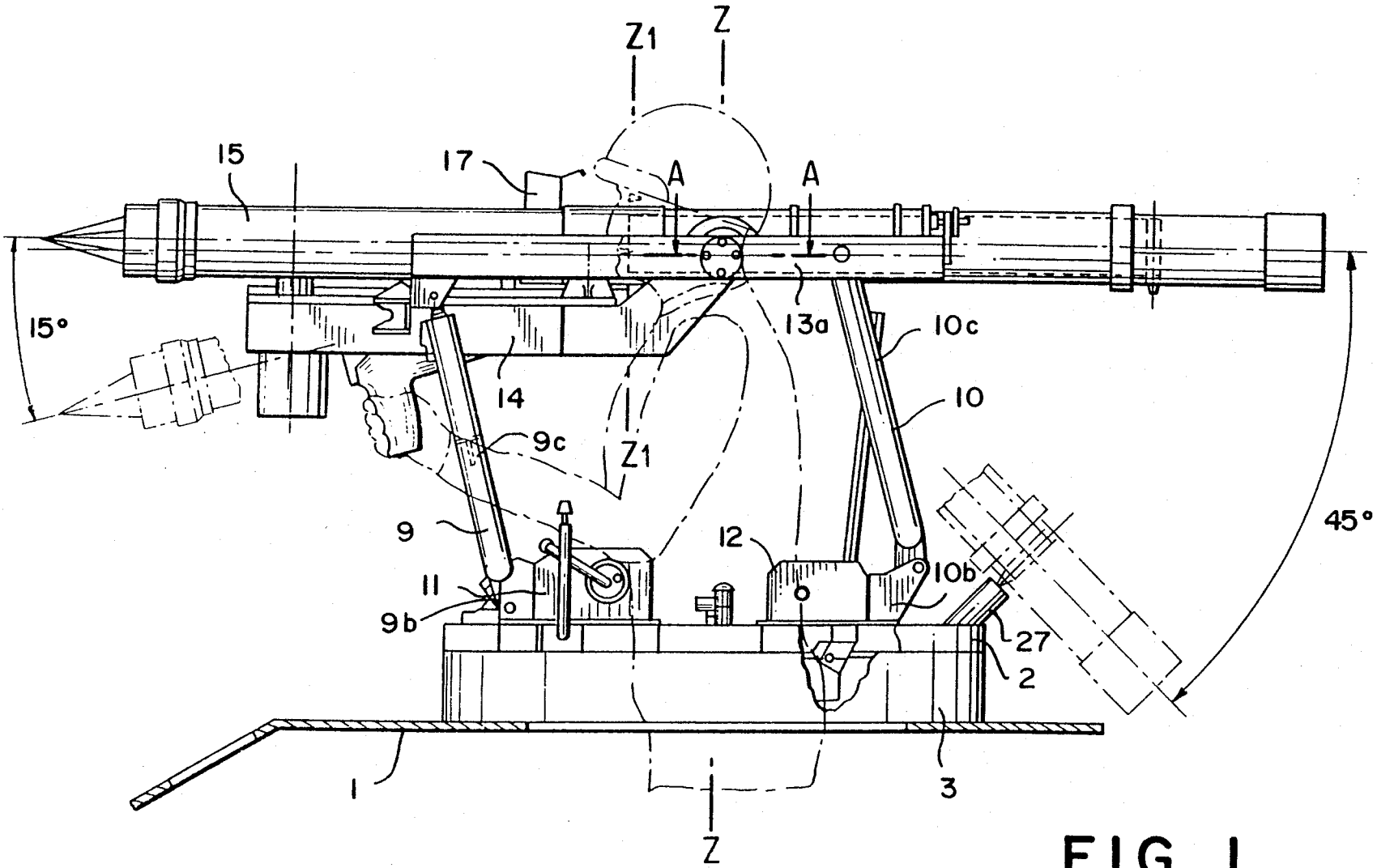
FIG. 1 is a side view of the turret according to the present invention in the deployed position.

A first mounting member 9 is pivotally attached to the support plate 2 in front of the azimuth axis Z—Z and a second mounting member 10 is pivotally attached to the support plate 2 at a position rearwardly of the azimuth axis Z—Z as illustrated in FIGS. 1 and 2. The forward position of the armored vehicle is illustrated as being toward the left in FIGS. 1 and 2, while the rear of the vehicle is toward the right in these figures.

The first and second mounting members 9 and 10 have a generally "U" shape comprising a base **9*a* and 10*a* with two arms, 9*c*, 9*d*, 10*c* and 10*d* extending from either side of the bases. Base 9*a* is pivotally attached to the support plate 2 via yokes 9*b*, while mounting member base 10*a* is attached to the support plate 2 via mounting yokes 10*b*. The axes about which the first and second mounting members 9 and 10 pivot extend generally parallel to each other and, when the turret is in the forward facing position shown in FIGS. 1 and 2, these axes may extend generally laterally across the vehicle. The yokes 9*b* may be attached to support boxes 11, while yokes 10*b* may be attached to support boxes 12. Support boxes 11 and 12 are fixedly attached to the upper surface of support plate 2 so as to pivotally support each of the mounting members 9 and 10**.

Crossbars 13*a* and 13*b* interconnect the upper portions of arms 9*c* and 10*c*, as well as upper portions of arms 9*d* and 10*d*, respectively. The crossmembers 13*b* and 13*b* are pivotally attached to the upper portions of each of the respective arms such that the assembled structure is movable as a four-bar linkage between a stowed position, shown in FIG. 2 and a deployed position, shown in FIG. 1. Arms 9*c*, 9*d*, 10*c* and 10*d* may be the same length so that crossmembers 13*a* and 13*b* are substantially horizontal in both the stowed and deployed positions.

Figure 4:
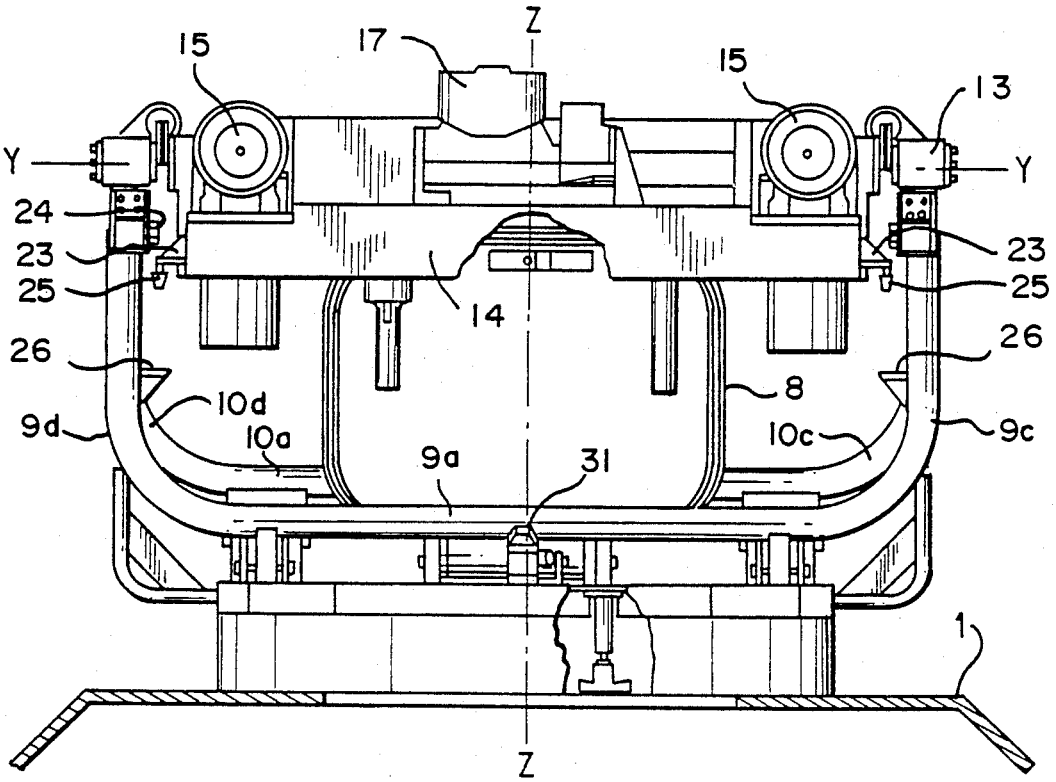
FIG. 4 is a front view of the turret of FIG. 1 in its deployed position.
Figure 3:
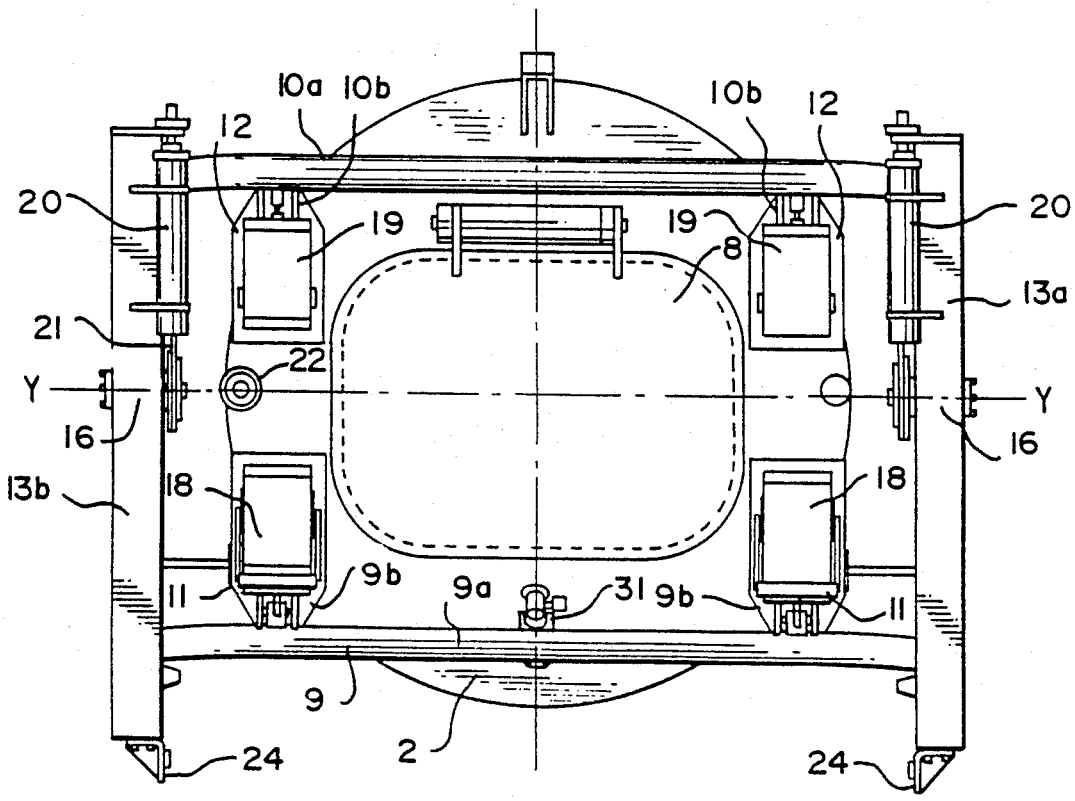
FIG. 3 is a top view of the turret according to the present invention in the deployed position.

Weapons support means 14 is pivotally attached to crossmembers 13*a* and 13*b* so as to pivot about an elevational axis Y—Y, illustrated in FIGS. 3 and 4. Axis Y—Y extends in a generally horizontal direction generally perpendicular to the azimuth axis Z—Z. When the turret is in its deployed position, illustrated in FIGS. 1, 3 and 4, the elevational axis Y—Y and the azimuth axis Z—Z are located in a common, generally vertically extending plane. Bearings 16 are utilized to attach the weapons support means 14 to the crossmembers 13*a* and 13*b*. Weapons support means 14 may support a plurality of weapons 15, which may include machineguns, rockets, or laser powered weapons. In known fashion, a sighting device 17 is located on the weapon support means 14 in front of the operator, as illustrated in FIG. 1.

The center gravity of the weapon support means 14 is generally located along axis Z1—Z1 which, as illustrated in FIGS. 1 and 2, is in front of the azimuth axis Z—Z in both the stowed and deployed positions. Depending upon the particular weapon utilized, this location may render it difficult for the operator to raise the turret from its stowed to its deployed position. Therefore, means are provided to assist the operator in such movement. The means may comprise deployment actuators 18 and 19 operatively associated between the support plate 2 and the mounting members 9 and 10, respectively. The actuators 18 and 19 may be mounted on support boxes 11 and 12, respectively, and may comprise mechanical actuators of the power cylinder type having an extendable and retractable piston rod. The piston rods may be attached to yokes 9*b* and 10*b*, respectively, such that, as the rods are extended or retracted, pivotal movement is imparted to the first and second mounting members 9 and 10 so as to move the turret between the stowed and deployed positions.

Since the weapon supports means 14 may carry two weapons, such as rockets, the deployment actuators 11 may have means to disengage them in order to balance the forces exerted on the turret when it carries only one weapon.

Elevational actuating means may also be provided to assist the operator in rapidly adjusting the elevational position of the weapon support means 14. The elevational actuating means may comprise mechanical actuator 20 attached to each of the crossmembers 13*a* and 13*b*, respectively. Actuator 20 may, again, comprise a mechanical actuator having an extendable and retractable rod wherein the rod is connected, via cable 21, to a pulley attached to the weapon support means 14 at its elevational axis Y—Y. As the rod of the actuator 20 is extended or retracted, movement of the cable causes the pulley to rotate about axis Y—Y, thereby assisting the operator in adjusting the elevational position of the weapon support means 14.

The turret according to the invention may also incorporate various locking systems. An azimuth locking bolt 22 may be located in support plate 2 such that it will lock the support plate 2 in a position wherein the weapons 15 on the weapon support means 14 face the front of the vehicle. Lock bolt 22 may, of course, be easily released by the operator to enable the turret to pivot about the aximuth axis Z—Z. In known fashion, the lock bolt 22 may be spring biased such that it automatically locks the turret in the forward-facing position the first time the turret passes into this position.

Locking device 31 may also be operatively interposed between the first mounting member 9 and the support plate 2 to lock the first mounting member 2 in either its stowed or its deployed position.

Elevational locking means may also be provided to lock the weapon support means 14 in a generally horizontal position. Latches 23 may be located on either side of the weapon support means 14 and may, in known fashion, engage correspondingly located sears 24 mounted on the crossmembers 13*a* and 13*b*. The elevational locking device may be utilized to lock the weapons in a generally horizontal position when the turret is in its stowed position on top of the vehicle.

Generally speaking, the elevation of the weapon support means 14 and, the weapon 15, is variable between −15° and +45°. Stops 25 may be provided on the weapons support means 14 to limit the downward angle by coming into contact with plates 26 extending from arms 9*c* and 9*d*, respectively. This will prevent damage to the front of the vehicle when the weapon is fired. The upward elevational angle of the weapon support means 14 is limited by stop 27, located on the rear portion of the support plate 2. This stop 27 contacts a stop located on the rear portion of the weapon, as illustrated in FIG. 1.

Figure 5A:
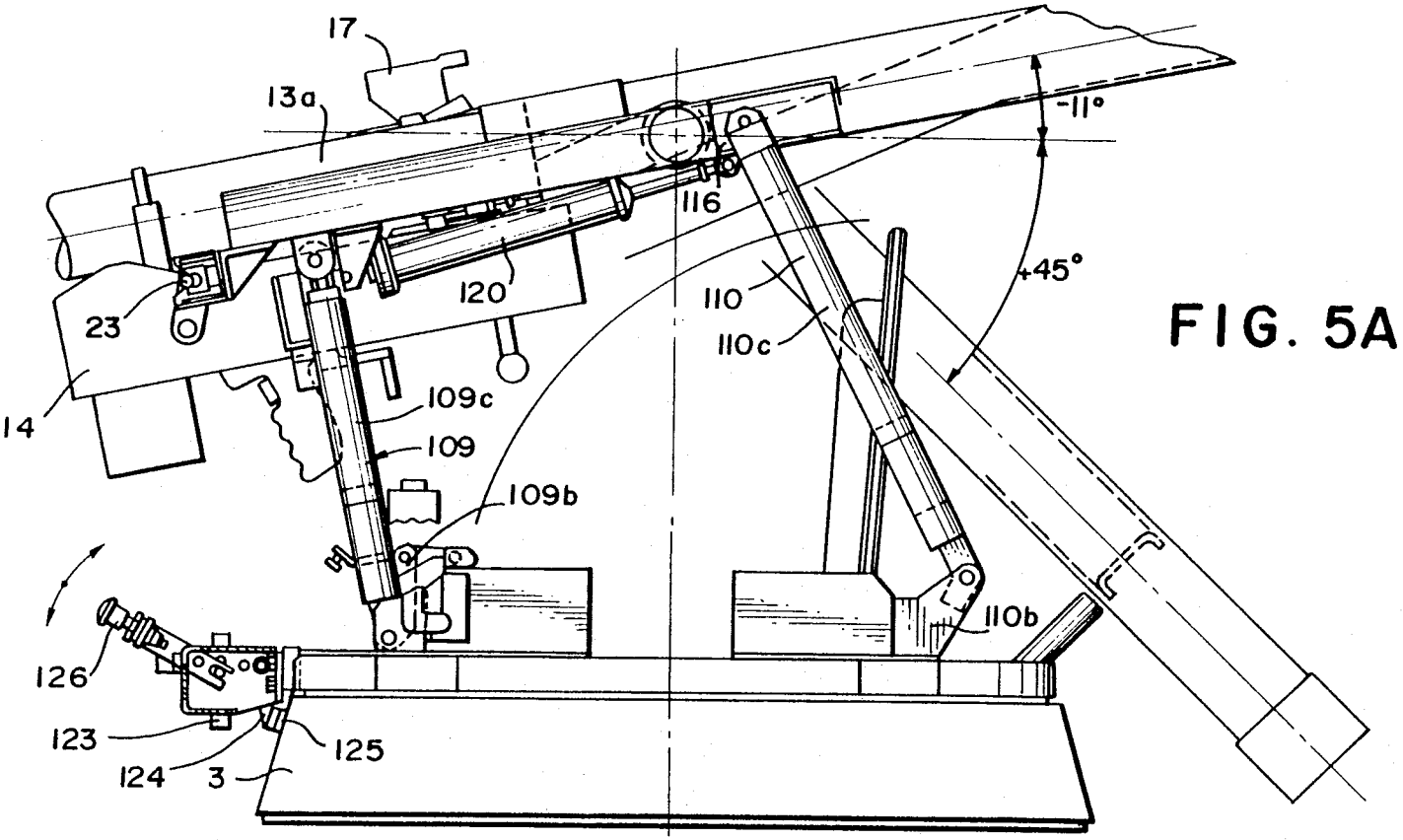
FIG. 5A is a side view of an alternative embodiment of the turret according to the present invention in its deployed position.
Figure 5B:
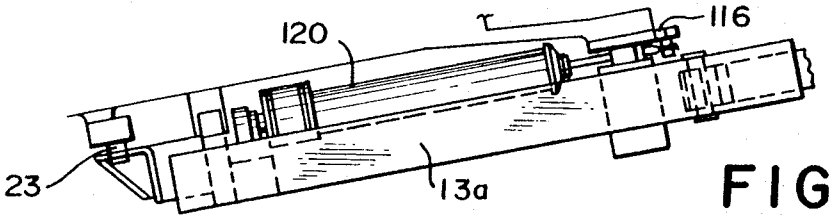
FIG. 5B is a partial, top view of the turret shown in FIG. 5A illustrating the attachment of the weapon support actuator.

An alternative embodiment of the turret according to the present invention is illustrated in FIGS. 5A and 5B. In these figures, elements identical to the previously discussed embodiment are denoted by the same reference numerals, whereas the modified elements have the reference numeral increased by 100. This embodiment differs from the previously discussed embodiment insofar as the arms 110*c* and 110*d* of the second support member 110 are longer than the corresponding arms 109*c* and 109*d* on the first mounting member 109. Thus, in the deployed position, as illustrated in FIG. 5A, the crossmembers 13*a* and 13*b* will be disposed in a position tilted downwardly towards the front on the vehicle in an angle corresponding to the minimum downward angle in which the weapon may be fired. This embodiment provides the operator with a greater azimuth observation field and improves the locking safety of the weapons support member 14 to the turret structure.

The elevational actuators 120 in this embodiment may differ from those previously discussed. In this embodiment, the actuators 120 again comprise mechanical-type actuators having extendable and retractable rods. The actuator itself is attached to the crossmembers 13*a* and 13*b* while the rod is directly, pivotally connected to the yoke 116 attached to the weapon support means 14. Thus, extension and retraction of the piston rod assists in the movement of the elevational position of the weapon support means 14 about elevational axis Y—Y.

The azimuth locking means in this embodiment may be automatic or may be manually carried out. An adjustable stop is attached to first mounting member 109 which releases latch 124 engaged with sear 125 formed on collar 3. Thus, when the system is being stowed, the latch 124 automatically engages the sear 125 to lock the azimuth position of the support plate 2. As the turret is moved to its deployed position, the latch 124 is manually released by moving bolt 126 in a downward direction. The operator can also lock the rotary support plate 2 by manually activating the bolt 126 in an upward direction.

The forgoing description is provided for illustrative purposes only and should not be construed as in anyway limiting this invention, the scope of which is defined solely by the dependent claims.

We claim:

1. A turret for supporting one or more weapons on a vehicle having a front and rear comprising:

a) a support plate mounted on the vehicle so as to rotate about a generally vertically extending azimuth axis;

b) a first mounting member attached to the support plate so as to pivot about a first axis, the first mounting member having a general "U" shape with a base and two arms extending from the base;

c) a second mounting member attached to the support plate so as to pivot about a second axis extending generally parallel to the first axis, the second mounting member having a general "U" shape with a base and two arms extending from the base;

d) a pair of crossmembers: a first crossmember pivotally connected to an arm of the first mounting member and to a corresponding arm of the second mounting member; and a second crossmember pivotally connected to an opposite arm of the first mounting member and to a corresponding arm of the second mounting member such that the mounting members and the crossmembers are movable as a four-bar linkage between a stowed position and a deployed position; and, e) weapon support means pivotally attached to the crossmembers so as to pivot about an elevational axis such that the weapon support means is movable between minimum and maximum angles of elevation.

2. The turret according to claim 1 wherein the first mounting member is located in front of the azimuth axis, the second mounting member is located to the rear of the azimuth axis and wherein the arms of the second mounting member are longer than those of the first mounting member such that, in the deployed position, the crossmembers are oriented at a minimum elevational angle for the weapon support means.

3. The turret according to claim 1 wherein the first mounting member is located in front of the azimuth axis, the second mounting member is located to the rear of the azimuth axis and wherein the arms of the first and second mounting members are generally of equal length such that the crossmembers are generally horizontal when the mounting members are in their deployed and stowed positions.

4. The turret according to claim 1 wherein the elevational axis is co-planar with the azimuth axis when the mounting members are in their deployed positions.

5. The turret according to claim 1 further comprising elevational locking means operatively associated with the weapon support means to releasably lock the weapon support system in a generally horizontal position.

6. The turret according to claim 1 further comprising an armored door hatch pivotally attached to the support plate so as to be movable between closed and open positions.

7. The turret according to claim 1 wherein the weapon support system operatively supports at least one rocket launcher.

8. The turret according to claim 1 further comprising at least one deployment actuator means operatively associated with the first and second mounting members to assist in moving the mounting members between their stowed and deployed positions.

9. The turret according to claim 8 wherein the deployment actuator means comprises:

a) a first pair of mechanical actuators operatively associated with the first mounting member; and, b) a second pair of mechanical actuators operatively associated with the second mounting member.

10. The turret according to claim 1 further comprising lock means operatively associated with the support plate and the first mounting member to lock the first mounting member in either its stowed or its displayed position.

11. The turret according to claim 10 further comprising azimuth locking means operatively associated with the support plate to releasably lock the support plate in a pre-determined position.

12. The turret according to claim 1 further comprising elevational actuating means operatively associated with the weapons support means to assist in moving the weapon support means about the elevational axis.

13. The turret according to claim 12 wherein the elevational actuating means comprises:

a) pulley means operatively associated with the weapon support means so as to pivot about the elevational axis;

b) at least one third mechanical acuator; and, c) cable means operatively connecting the third mechanical actuator to the pulley means.

14. The turret according to claim 12 wherein the elevational actuating means comprises a mechanical actuator operatively interposed between a crossmember and the weapon support means.

* * * * *

UNITED STATES PATENT AND TRADEMARK OFFICE

CERTIFICATE OF CORRECTION

PATENT NO. : 5,056,409

DATED : October 15, 1991

INVENTOR(S) : ALLAIS et al.

It is certified that error appears in the above-identified patent and that said Letters Patent is hereby corrected as shown below:

Col. 1, line 39, change "amored" to --armored--.

Col. 3, line 3, change "13b" to --13a--.;
line 23, change "machineguns" to --machine guns--;
line 28, change "centergravity" to --center of gravity--.

Col. 4, line 6, change "aximuth" to --azimuth--.

Signed and Sealed this

Sixteenth Day of November, 1993

*Attest:*

*Attesting Officer*

BRUCE LEHMAN

*Commissioner of Patents and Trademarks*